US005415112A

United States Patent [19]

Takahashi

[11] Patent Number: 5,415,112

[45] Date of Patent: May 16, 1995

[54] INCINERATOR

[76] Inventor: Kenzo Takahashi, 2-7-11 Shinkawa, Chuo-Ku, Tokyo, Japan

[21] Appl. No.: 225,715

[22] Filed: Apr. 11, 1994

[30] Foreign Application Priority Data

Apr. 26, 1993 [JP] Japan ..... 5-099684

[51] Int. Cl.[6] ..... F23G 5/06

[52] U.S. Cl. ..... 110/246; 110/204; 110/255; 432/106; 432/105

[58] Field of Search ..... 110/246, 204, 255; 432/103, 106, 107, 105

[56] References Cited

U.S. PATENT DOCUMENTS

| | | | |
|---|---|---|---|
| 4,961,391 | 10/1990 | Mak et al. | 110/246 |
| 5,020,455 | 6/1991 | Takashi et al. | 432/106 |
| 5,042,402 | 8/1991 | Freeman | 110/246 |
| 5,081,937 | 1/1992 | Ishida | 110/246 |
| 5,174,750 | 12/1992 | Flading et al. | 110/246 |
| 5,273,355 | 12/1993 | May et al. | 432/106 |

*Primary Examiner*—Harry C. Yuen

*Attorney, Agent, or Firm*—John R. Benefiel

[57] ABSTRACT

An incinerator is described which includes a cylindrical rotary furnace slightly inclined downwardly in its longitudinal direction for combusting material introduced into an entrance, a cylindrical housing for housing the furnace and a secondary combustor connected with an exit of the furnace. Partition plates are placed in an annular space between the housing and the furnace for defining a combustion air introduction zone below the furnace and recirculated gas introduction zone above the combustion air introduction zone. A gas recirculation duct extends from the secondary combustor to the furnace housing for introducing a portion of the gas flow discharged from the secondary combustor into the recirculated gas introduction zone. An external air flow is introduced to the combustion air introduction zone. The recirculated gas lowers the,temperature of the furnace and this results in reduced NOx generation. Further, since the combustion air flow enters the furnace from the bottom side of the furnace, it is effectively used in incineration.

33 Claims, 9 Drawing Sheets

INCINERATOR

BACKGROUND OF THE INVENTION

The present invention relates to an incinerator for burning combustible material such as municipal trash or waste.

Generally, when waste is burned in an incinerator, it is fed into one end of an elongated cylinder rotary furnace defining a combustion chamber, and an air flow is directed over the waste into the interior of the rotary furnace to support the combustion. Combustion exhaust gas and ashes are removed from the other end of the furnace. However, the waste is often not sufficiently mixed with the combustion air flow to create complete burning so that a considerable amount of residual waste remains after incineration.

A high volume of air flow is typically directed into the furnace in an attempt to improve the completeness of combustion, substantially raising furnace temperatures to excessive levels.

If the temperature of the furnace is elevated, the service life of the furnace components is reduced. To overcome this problem, a water cooling wall is provided around a periphery of the rotary furnace and a number of openings are formed therein to define a boiler space, creating an integrated boiler and furnace. With this structure, the combustion air flow can be introduced from the furnace bottom to improve combustion. However, a boiler-integrated furnace is expensive.

Conventional waste incinerators have another problem: since the temperature of the furnace reaches very high levels, a harmful gas (NOx) is generated by combustion in the furnace. To eliminate this problem, a reduction apparatus may be provided on a gas discharge duct. However, this makes the incineration system complicated and expensive.

Therefore, an object of the present invention is to provide an incinerator which does not have a boiler, but can supply an air flow in a desired manner and prevent the furnace from reaching excessive temperatures.

SUMMARY OF THE INVENTION

According to one aspect of the present invention, an incinerator is provided which includes a rotary cylinder defining a furnace combustion chamber, the cylinder extending generally horizontally, slightly inclined downwardly in its longitudinal direction. Material to be combusted is introduced into an entrance at an upstream end of the furnace. A housing encloses the furnace, and a secondary combustor is connected with an exit at a downstream end of the furnace. A gas recirculation duct extends from the secondary combustor to the furnace housing for introducing a portion of the gases discharged from the secondary combustor into a space between the housing and the furnace.

A combustion air supply duct also introduces combustion air into the space between the housing and the furnace. Seals are provided in the space between the housing and the furnace for defining a combustion air introduction zone in the space in a region located below the furnace, and a recirculated gas introduction zone located above the combustion air introduction zone.

According to the invention, the gas recirculation duct directs part of the combustion exhaust gas flow back into the furnace. This lowers the temperature of the furnace and results in reduced NOx generation. The seals and combustion air introduction zone cause the combustion air to enter the furnace from the bottom of the furnace so that the combustion air is effectively mixed with the burning material. Likewise, the seals and recirculated gas introduction zone direct the flow of recirculated gas into contact with an upper portion of the furnace so that the flow of recirculated gas will cool the furnace.

It should be noted that the temperature of the combustion exhaust gas naturally drops as it flows from the second combustor to the furnace and accordingly its temperature is lower than the temperature of the furnace when it comes into contact with the outside of the furnace.

The second combustor is provided for completely burning the residual waste, as well as the combustion exhaust gas received from the furnace.

A wind box may be mounted to the furnace exit located at the downstream end of the furnace. The combustion air supply duct and gas recirculation duct may be connected to the wind box, and the combustion air introduction zone and recirculated gas introduction zone may extend from the wind box to the entrance of the furnace. The combustion air introduction zone and recirculated gas introduction zone may have a plurality of openings in their respective upstream portions.

With this structure, the combustion air and the recirculated gas flow in the longitudinal direction of the furnace from the downstream exit end of the furnace to the upstream entrance end of the furnace, and enter the furnace from the openings in the respective zones.

The furnace may be a rotary furnace and a lateral wall of the furnace may include a plurality of angles extending in the longitudinal direction of the furnace. In this case, the waste is tumbled as the furnace rotates. This further improves combustion.

DETAILED DESCRIPTION

In the following detailed description, certain specific terminology will be employed for the sake of clarity and a particular embodiment described in accordance with the requirement of 35 USC 112, but it is to be understood that the same is not intended to be limiting inasmuch as the invention is capable of taking many forms and variations within the scope of the appended claims.

Figure 1A:
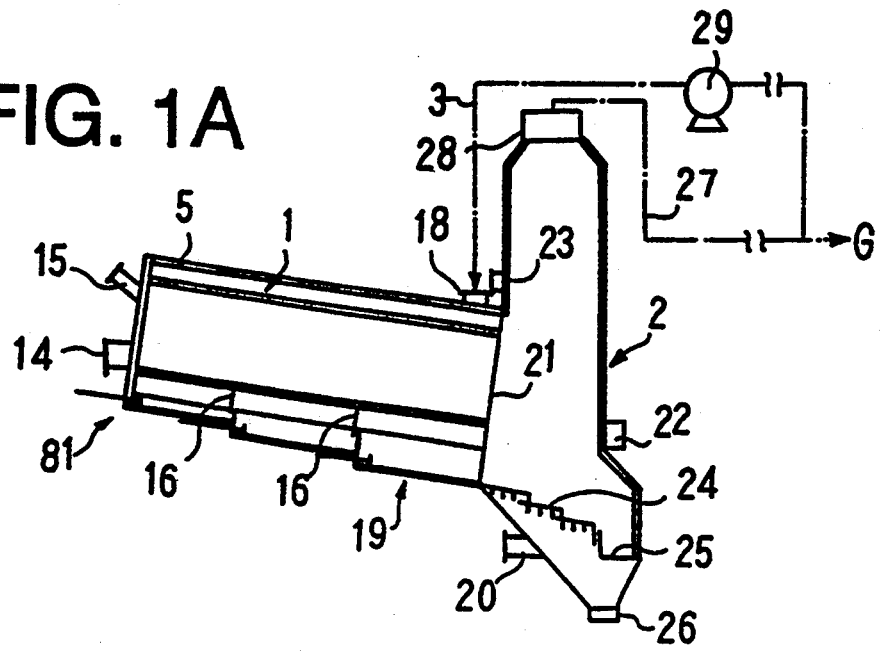
FIG. 1A shows a lateral section of an incinerator according to one embodiment of the present invention.
Figure 1B:
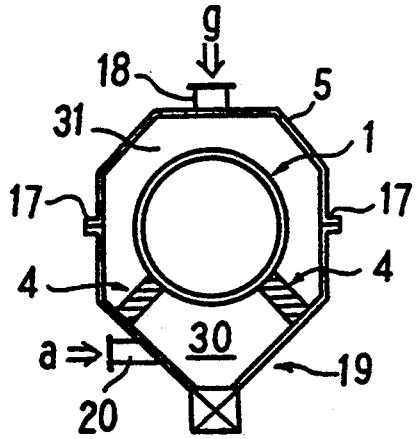
FIG. 1B shows a front section of the incinerator illustrated in FIG. 1A.

Referring to FIGS. 1A and 1B, illustrated is an incinerator for combusting waste according to a first embodiment of the present invention. The incinerator includes an elongated cylindrical rotary furnace 1 comprising a combustion chamber for combusting the waste. Housing means are provided comprised of a housing 5 which encloses the rotary furnace 1, and a secondary combustor comprised by a second furnace 2 is connected to an exit of the rotary furnace 1. A gas recirculation duct 3 introduces part of the gases G discharged from the secondary combustor 2 into the rotary furnace 1 and seals 4 are provided in the space between the housing 5 and the rotary furnace 1.

Figure 3:
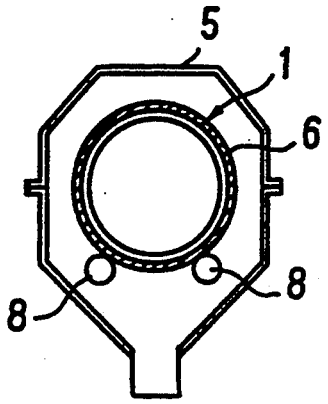
FIG. 3 is another front section of the incinerator shown in FIG. 1A.
Figure 4:
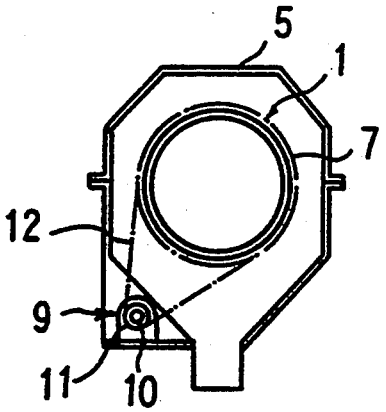
FIG. 4 is still another front section of the incinerator shown in FIG. 1A.
Figure 5:
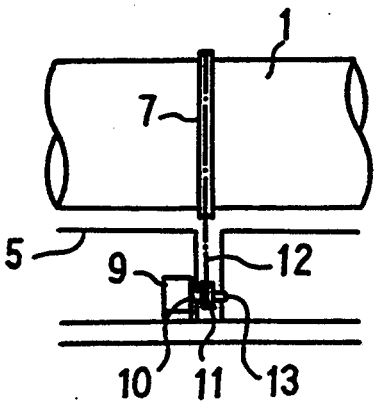
FIG. 5 is a lateral view of the incinerator as shown in FIG. 4.

The rotary furnace 1 takes the form of an elongated cylinder lined with castable refractories. The furnace 1 is rotatably supported in the housing 5 on rollers 8 (FIG. 3), and slightly inclined downwardly. As illustrated in FIG. 3, a ring 6 fits over a periphery of the furnace i and teeth 7. (FIGS. 4, 5) are formed on the ring 6. The ring 6 engages the pair of rollers 8 to support the furnace 1. As illustrated in FIG. 4, the teeth 7 are driven by an output shaft 10 of a drive motor 9 via a sprocket 11 and a chain 12. The drive motor 9 is supported separately from the furnace 1 and located externally of the housing 5, as shown in FIG. 5. The output shaft 10 of the motor 9 extends into the housing 5 and the sprocket 11 is mounted on the end of the output shaft 10. A shaft seal 13 is provided in a bearing portion of the sprocket 11.

Referring back to FIG. 1A, a waste entrance 14 is formed at an upstream end of the furnace 1 and an ignition nozzle 15 is mounted above the waste entrance 14. Partition plates 16 extend radially outward from the periphery of the furnace 1 to form three air chambers below the furnace 1. An appropriate volume of air flow is directed into each chamber, the flow of air controlled in a conventional manner as will be described herein. It should be noted that the furnace 1 is not divided into three zones by the partition plates 16, but there are three combustion zones in the furnace corresponding to the three air chambers.

As best seen in FIG. 1B, the housing 5 can be formed by two vertically aligned pieces, joined to each other with abutting flanges 17, held together as by bolts (not shown). A gas inlet duct 18 is connected to the upper wall of the housing 5 at the downstream end of the casing 5. A flow of recirculated gas "g" passes into the housing 5 from the duct 18 (FIG. 1B). A lower wall 19 of the housing 5 is shaped like "V" in its front view, as illustrated in FIG. 1B. An air inlet duct 20 is connected to the lower wall 19 of the housing 5 for introduction of combustion air "a".

The secondary combustor 2 is a cylindrical vertical furnace and its lateral wall has an opening connected with an exit 21 of the rotary furnace 1. A burner 22 is mounted on the opposite lateral wall of the secondary combustor 2 and faces the exit 21 of the rotary furnace 1. Attached to the lateral wall of the secondary combustor 2 just above the exit opening 21 of the rotary furnace 1 is a nozzle 23 for injecting a flow of secondary combustion air.

An after-burning stoker 24 is provided in a bottom area of the secondary combustor 2 so that residual waste which drops from the exit 21 of the rotary furnace 1 is burned therein. Ashes discharged from the rotary furnace 1 and generated by the after-burning stoker 24 are transferred to a discharge opening 26 of the second combustor 2 by an ash damper 25. The secondary furnace 2 has a gas exit duct 28 at its top and a gas discharge duct 27 extends from the duct 28 to deliver combustion exhaust gas G out of the secondary furnace 2.

The gas recirculation duct 3 is branched from the gas discharge duct 27 at a point downstream of a boiler (not shown) or a gas cooling device (not shown) such that part of the combustion exhaust gas G which has undergone heat exchange therein is recirculated by a fan 29.

As illustrated in FIG. 1B, seals 4 are provided between the lower wall 19 of the housing 5 and the periphery of the rotary furnace 1 to define a first introduction zone 30 for the combustion air "a" located below the furnace 1 and a second introduction zone 31 for the recirculated gas "g" above the combustion air zone 30. In this embodiment, an angle made by the two seals 4 in FIG. 1B is about 90 degrees.

Figure 2:
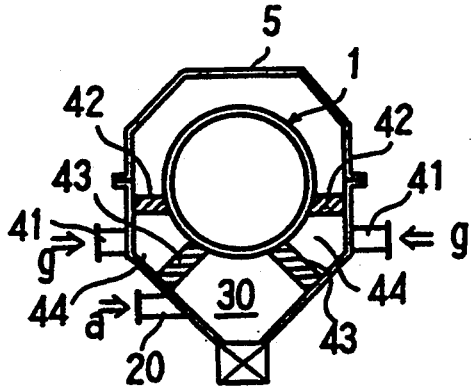
FIG. 2 is a front section of a modification of the incinerator shown in FIG. 1B.

Referring to FIG. 2, it should be noted that recirculated gas entrance ducts 41 may be connected with opposite lateral walls of the lower housing piece and seals 42 and 43 may be provided above and below the ducts 41, respectively. In this case, a space 44 between each associated pair of seals 42 and 43 defines a recirculated gas introduction zone. It is possible to maintain recirculated gas pressure and combustion air pressure approximately the same to substantially reduce leakage of the combustion air "a" in the upward direction.

Figure 6:
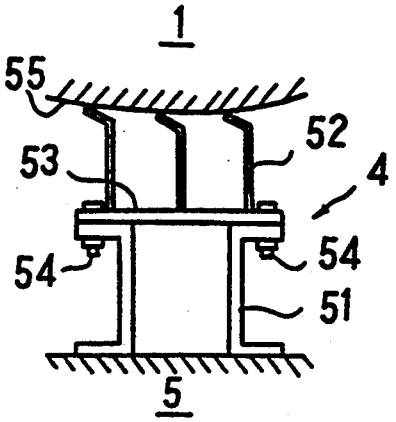
FIG. 6 is an enlarged view of seals shown in FIG. 1B.

Referring to FIG. 6, details of the seals 4 are shown, which include a pair of space apart U-shaped lightweight channels 51, a support plate 53 spanning the channels 51, and three parallel thin seal plates 52 projecting upwardly from the support plate 53. The support plate 53 is fixed on flanges of the channels 51 by bolts 54. The channels 51 are fixed on the inner wall of the housing 5. Each seal plate 52 extends generally in a radial direction of the rotary furnace 1 and is made from stainless steel (SUS 304). A free end of each thin seal plate 52 is angled in the direction of rotation of the rotary furnace 1 and slides on the periphery 55 of the rotary furnace 1. The seal plates 52 also extend in a longitudinal direction of the rotary furnace 1 (i.e., in a direction perpendicular to the plane of the drawing sheet).

Figure 7:
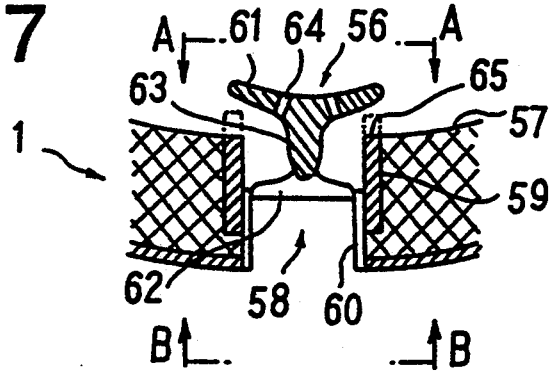
FIG. 7 is a fragmentary sectional view of a nozzle installed in the incinerator shown in FIG. 1A.
Figure 8:
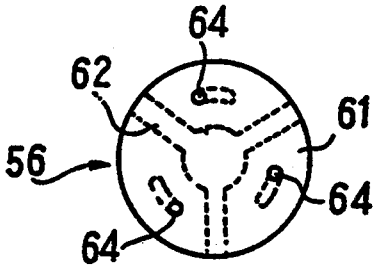
FIG. 8 is an illustration of the nozzle shown in FIG. 7 as viewed in a direction indicated by the arrows A in FIG. 7.
Figure 9:
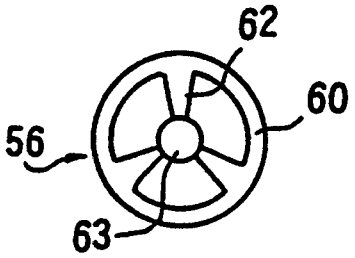
FIG. 9 is an illustration of the nozzle of FIG. 7 as viewed in a direction indicated by the arrows B in FIG. 7.

Referring to FIG. 7, the rotary furnace 1 has a plurality of openings 58 in its wall, only one opening illustrated in FIG. 7 for the sake of clarity. A nozzle 56 fits in each opening 58 for introducing the combustion air "a" and the recirculated gas "g" into the furnace 1. Each opening 58 is of 2 to 3 inch-diameter, for example, and is defined by a tubular member 59. The nozzle 56 includes a ring 60, a dish-like portion 61, ribs 62 and a shaft portion 63. The ring 60 fits in the tubular member 59. The dish-like portion 61 is larger in diameter than the bore 58. The ring 60 is connected with the dish-like portion 61 by the ribs 62 and the shaft portion 63. Three ribs 62 extend from the ring 60 to the shaft portion 63, as illustrated in FIG. 9. The dish-like portion 61 extends parallel to the peripheral wall 57 of the rotary furnace 1 and has a plurality of small openings 64, as shown in FIG. 7. Three openings 64 are formed in the dish-like portion 61, as shown in FIG. 8. Each opening 64 is inclined relative to a center axis of the shaft portion 63, as shown in FIGS. 7 and 8.

Thus, the combustion air "a" (or the recirculated gas "g") which enters a space between the housing 5 and the rotary furnace 1 flows in the bores 58 of the peripheral wall 57 of the rotary furnace 1 and is directed to a clearance between the dish portion 61 of the nozzle 56 and a free end 65 of the tubular member 59. Accordingly, most of the air "a" (or gas "g") flows along the inner surface of the peripheral wall 57 of the rotary furnace 1 and the remainder passes through the openings 64 formed in the dish portion 61. The latter becomes gas jet swirls directed in a generally radially inward direction (upward direction in FIG. 7).

The clearance between the dish portion 61 and the tubular member 59, i.e., the nozzle projection height, is determined by the nature of the waste to be incinerated. If the waste includes a liquid or a liquid is generated upon combustion in the furnace 1, such a liquid may leak from the furnace 1 through the openings 58. To avoid this, the tubular member 59 may be elongated upward as indicated by the broken line in FIG. 7. The extending portion of the tubular member 59 may form a weir so that the liquid or/and wet waste or ashes do not leak from the openings 58. The nozzles 56 are preferably threaded into the bore 58.

Figure 10:
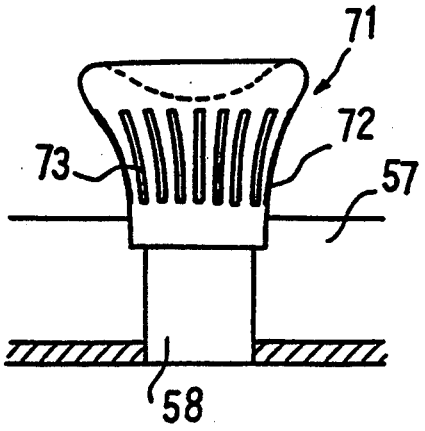
FIG. 10 is a side elevational view of a modification of the nozzle shown in FIG. 7.
Figure 11:
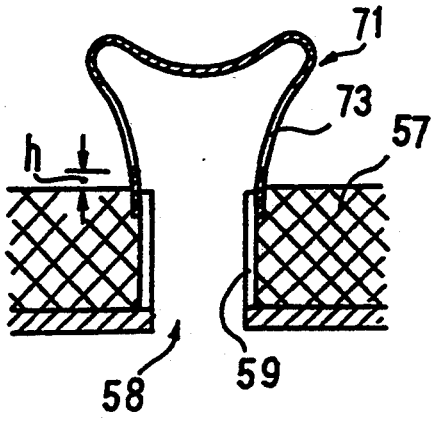
FIG. 11 is a vertical section of a nozzle shown in FIG. 10.

Referring to FIGS. 10 and 11, a cap-like nozzle 71 may be threaded into the tubular member 59 fitted in the bore 58. In this case, the nozzle 71 has a relatively large head 72 which projects into the rotary furnace 1. A plurality of slits 73 are formed parallel in the head 72 in a center axis direction of the bore 58. This prevents the waste from" falling into the bore 58. The distance "h" between the lower end of the slit 73 and the inner wall of the periphery 57 of the rotary furnace 1 (or how deep the nozzle 71 is threaded) is determined in accordance with the nature of the waste. As best understood from FIG. 7, the distance "h" serves as a weir to prevent liquid and wet wastes or ashes inside the furnace 1 from escaping through the slits 73. The air (or recirculated gas) enters the openings 58 and flows into the furnace 1 from the slits 73 in the right and left directions in FIG. 11.

Figure 12:
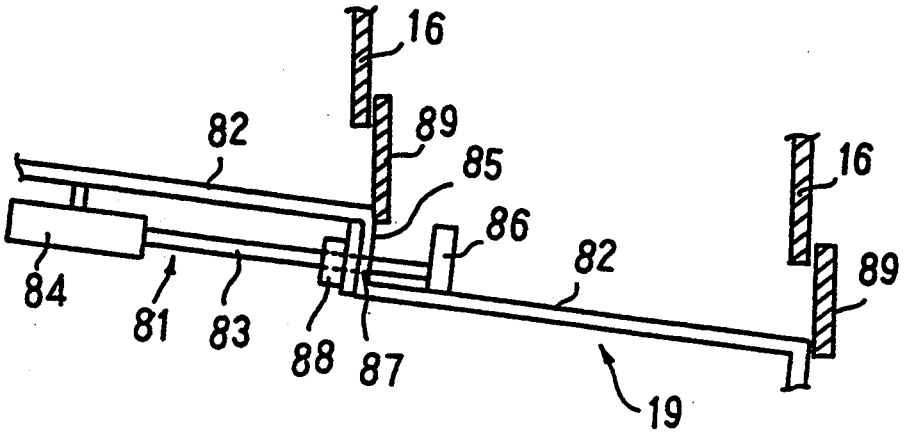
FIG. 12 is a fragmentary side elevational view of an ash transfer mechanism installed in the incinerator shown in FIG. 1A.

Referring back to FIG. 1A, an ash transfer mechanism 81 is provided in each combustion zone. The three ash transfer mechanisms 81 extend in series along the bottom 19 of the housing 5 so that they can push ashes, which fall from the peripheral bores 58 (FIG. 7), toward the exit of the housing 5. As illustrated in FIG. 12, the bottom 19 of the housing 5 is stepped, and three steps 82 are formed each corresponding to the three combustion zones.

Each ash transfer mechanism 81 includes a push rod 83 extending along the step surface 82 and a hydraulic cylinder 84 for extending and retracting the push rod 83. Each hydraulic cylinder 84 is mounted on a back side of the stepped surface 82. Each push rod 83 penetrates a vertical wall 85 of the step and has a slide plate 86 at its free end. The slide plate 86 can move along the step surface 82. A seal bearing 88 is provided in an opening 87 of the vertical wall 85 and movement of the push rod 83 is guided by the bearing 88. Below each partition plate 16, is a gate 89 which may be moved upwardly to open and allow the ashes pushed by the slide plate 86 to advance toward the exit of the housing 5. The opening upward movement of the gate 89 is synchronized with the movement of the push rod 83.

It should be noted that a ball screw may be employed instead of the hydraulic cylinder 84 as a device for extending and retracting the push rod 83.

Figure 13:
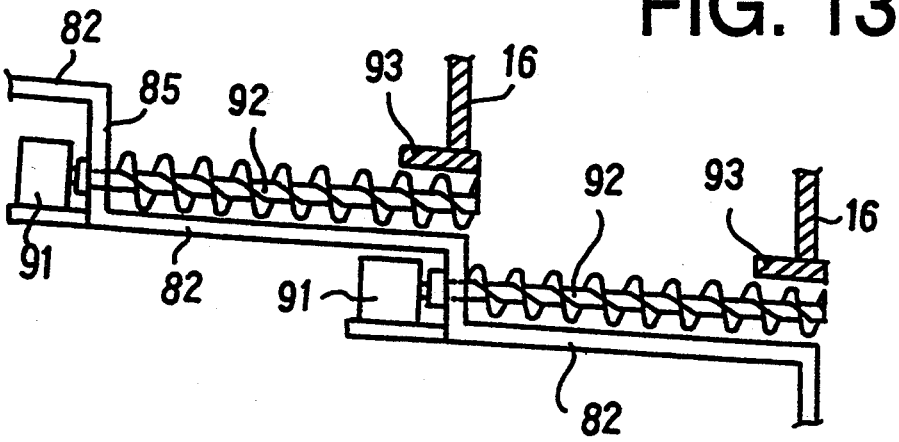
FIG. 13 is a side elevational view of a modification of the ash transfer mechanism.

Furthermore, as shown in FIG. 13, a motor 91 and a screw 92 may be provided instead of the hydraulic cylinder 84 and push rod 83 such that they constitute in combination a screw conveyor. In this case, the lower end of the partition plate 16 is spaced from the step surface 82 by a distance larger than a diameter of the spiral rod 92 and a guide 93 is attached to the lower end of the partition plate 16.

Operation of this embodiment is as follows:

The rotary furnace 1 is rotated at a prescribed speed by the motor 9 as shown in FIG. 4, and the flow of combustion air "a" is supplied into the rotary furnace 1 from the peripheral bores 58 via the nozzles 56 as shown in FIG. 7. As the wastes are fed into the rotary furnace 1 from the waste entrance 14, as shown in FIG. 1A, they are ignited by the ignition nozzle 15 and agitated while being tumbled upon rotation of the rotary furnace 1. As the furnace 1 rotates, the waste migrates toward the exit 21 of the rotary furnace 1 while being burned with an appropriate volume of flow of combustion air "a". If combustion is incomplete in the furnace 1, the burner 22 is activated.

Thus, most of the wastes are gasified upon combustion in the rotary furnace 1 and enter the secondary combustor 2, in which the residual waste and the exhaust gas are completely burned with a secondary air flow.

The combustion exhaust gas G is discharged from the second furnace 2 from the gas discharge duct 27. Part of the exhaust gas is recirculated to the rotary furnace 1 by the gas recirculation duct 3 and the temperature of the furnace 1 is lowered by the inert gas component of the recirculated exhaust gas. This also cools the surface of the rotary furnace 1 above the seals 4 (FIG. 1B). The ashes falling onto the bottom 19 of the housing 5 from the peripheral bores 58 of the rotary furnace 1 are transferred to the exit of the housing 5 by the ash transfer mechanisms 81 and discharged out of the incinerator via the after-burning stoker 24.

In this manner, since part of the exhaust gas "g" flows in the recirculation duct 3, through the space between the rotary furnace 1 and the housing 5 and into the rotary furnace 1 through the peripheral bores 58 of the rotary furnace 1, the temperature of the rotary furnace 1 is reduced by the cooling effect of the flow of recirculated exhaust gas "g". This prevents excessively high temperatures from being reached, and in turn prevents generation of NOx.

In addition, since the recirculated gas "g" cools the peripheral wall 57 of the rotary furnace 1, thermal damage of the peripheral bores 58 and other parts is reduced and the service life of these parts extended.

Further, since the nozzles 56 fit in the bores 58, the ashes do not escape through the bores 58 even if the diameter of each bore 58 is relatively large. Since each bore 58 can be of large diameter, it is possible to reduce the total number of the bores 58. In addition, since the nozzles 56 are threaded into the bores 58, maintenance is easy. Moreover, since the combustion air "a" and the recirculated gas "g" are caused to flow in a direction substantially parallel to the inner wall of the periphery 57, the air and the gas contact the waste effectively.

Because of the nozzles 56 (or 71), effective distribution of the combustion air flow is obtained. Further, these nozzles are easy to replace.

Figure 14:
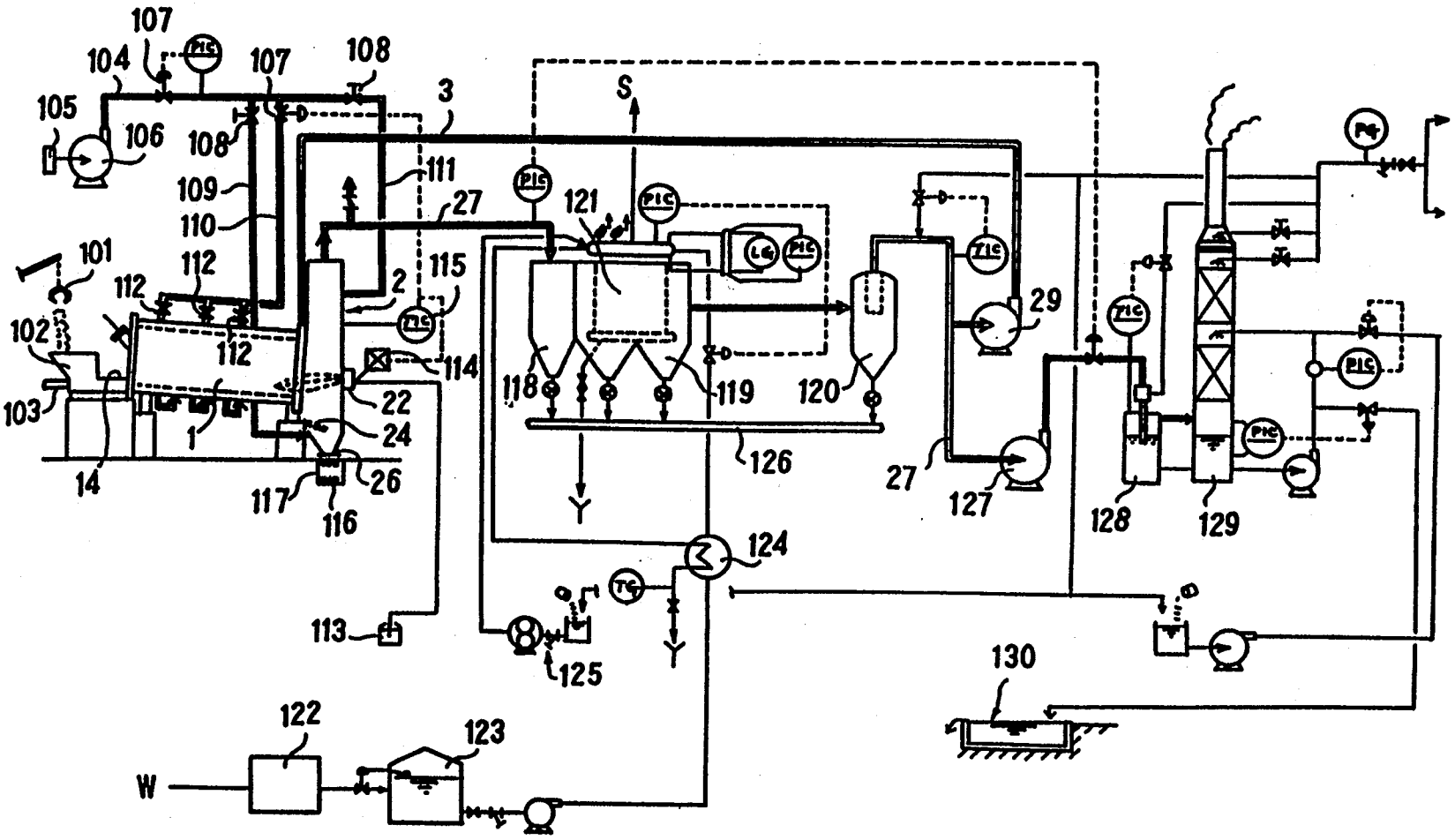
FIG. 14 is a diagrammatic representation of an incineration system which incorporates the incinerator shown in FIG. 1A.

An incineration system incorporating the above described incinerator is shown in FIG. 14.

The incineration system includes the rotary furnace 1, a hopper 102 at the waste entrance 14 of the rotary furnace 1 to receive the waste transmitted by a bucket 101 and a pusher 103 to push the waste in the hopper 102 to the waste entrance 14. A flow of combustion air "a" is fed from an air feed duct 104. The air feed duct 104 has three branch ducts 109, 110, and 111 and they are connected to the rotary furnace 1, the after-burning stoker 24 and the second furnace 2 to feed the combustion air "a", respectively. The external air at room temperature is filtered by a filter 105, pressurized by a fan 106 and flows in the air feed duct 104. Two types of valves 107 and 108 are provided on the main duct 104 and the branch ducts 109–111. The valve 107 is a control valve and the valves 108 are of the open or closed-type. The branch duct 110 extending to the rotary furnace 1 is further divided into three ducts for the three combustion zones. These three extend to an entrance space, a middle space and an exit space of the rotary furnace 1 and are provided with flow rate control valves 112, respectively.

The burner 22 is connected with a controller 114 and controlled thereby. A flow of fuel is fed to the burner 22 from an oil reservoir 113. The temperature of the second furnace 2 is detected by a temperature sensor 115 and a corresponding signal inputted to the controller 114, and the controller 114 determines whether further combustion is necessary (i.e., whether the burner 22 should be activated). Below the discharge opening 26 of the second furnace 2 is a water seal vessel 117 which has an ash transfer conveyor 116.

Located at a downstream end of a first segment of the gas discharge line 27, and extending from the top of the second furnace 2, are a plurality of cyclonic chambers 118, 119, and 120. A boiler 121 is placed in the intermediate chamber 119 to produce steam S. Service water W flows into a softener 122 and is stored in a water tank 123. The water W is fed to the boiler 121 from the water tank 123 via a heat exchanger 124. An unit 125 for chemical cleaning is connected with the boiler 121. Located beneath the chambers 118, 119, and 120, is another ash transfer conveyor 126.

A second segment of the exhaust gas duct 27 extends from the top of the most downstream chamber 120 and a fan 127 is provided thereon. The gas recirculation duct 3 is branched from the duct 27 upstream of the fan 127 to direct the gas back to the rotary furnace 1. The fan 29 is provided in the gas recirculation duct 3 to recirculate the exhaust gas.

According to the above-described structure, combustion exhaust gas from the second furnace 2 is cooled in the boiler 121 (or a gas cooler, not shown). Thus, when part of the exhaust returns to the rotary furnace 1, its temperature will be lowered. The periphery of the rotary furnace 1 is cooled by the recirculated gas whose temperature is lower than the temperature inside the rotary furnace 1.

At a downstream end of the exhaust gas line 27, there are provided a quenching vessel 128 and an absorption tower (scrubber) 129. The absorption tower 129 also functions as a chimney. An absorbent (NaOH) is fed into the absorber 129. Waste liquid from the absorption tower 129 passes to a waste water pond 130.

A second embodiment according to the present invention is shown in FIGS. 15 to 20.

Figure 15:
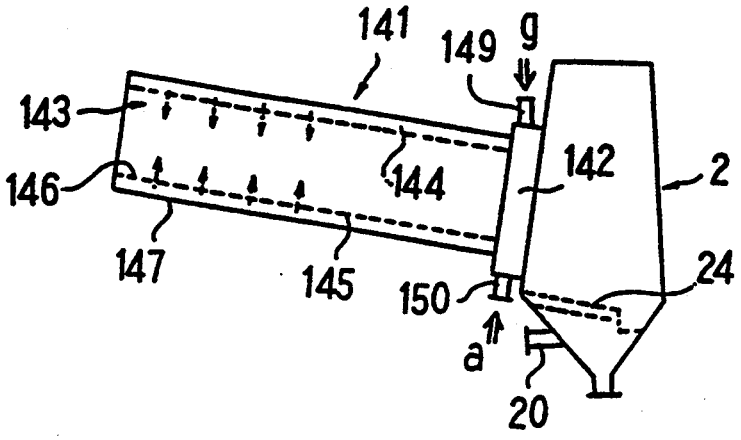
FIG. 15 shows a lateral section of an incinerator according to a second embodiment of the present invention.

Referring to FIG. 15, an incinerator includes a rotary furnace 141, a wind box 142 located downstream of the rotary furnace 141 and a secondary combustor 2 attached to a back side of the wind box 142. A peripheral wall 143 of the main furnace 141 has a double-wall structure; it is comprised of an inner cylinder 146 and an outer cylinder 147 enclosing the inner cylinder 146 to correspond to the housing means of the first embodiment. Recirculated gas "g" and combustion air "a" flow in the wind box 142, passing through an annular space 148 (FIG. 17) between the outer and inner cylinders 146 and 147 and the interior of the inner cylinder 146 in turn. Specifically, a recirculated gas introduction zone 144 and a combustion air introduction zone 145 are defined by the wind box 142 and the space between the inner and outer cylinders 146 and 147 of the rotary furnace 141, respectively. The wind box 142 is fixed on a lateral wall of the second furnace 2.

The rotary furnace 141 is provided with a drive mechanism (not shown) and bearing (not shown), which are similar to those shown in FIGS. 4 and 5 so that it is rotatable.

Figure 16:
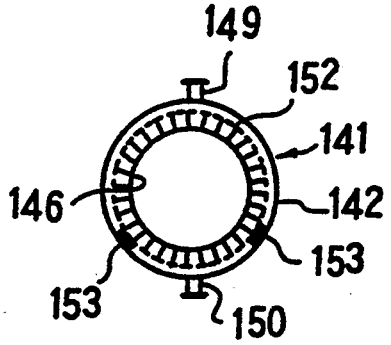
FIG. 16 is a front section of a wind box incorporated in the incinerator shown in FIG. 15.

A recirculated gas entrance tube 149 extends from a top of the wind box 142 and an air entrance tube 150 extends from a bottom of the wind box 142. As best seen in FIG. 16, the space between the inner and outer cylinders 146 and 147 is divided into two independent zones by elements 153; the upper three quarters of that space defines the recirculated gas zone and the rest is the combustion air zone.

Figure 17:
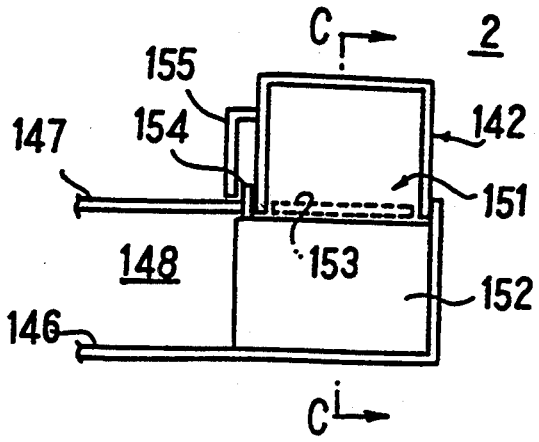
FIG. 17 is a lateral section of a major part of the wind box shown in FIG. 15.

Referring now to FIG. 17, the downstream end of the outer cylinder 147 is cut off to form an opening 151, the outer cylinder 147 shorter than the inner cylinder 146. The wind box 142 fits over the inner cylinder 146 at its downstream end, engaging in opening 151 and defines a ring-like passage in its circumferential direction.

A number of partition plates 152 radially extend from the inner cylinder 146, as illustrated in FIG. 16. The height of each partition plate 152 is slightly less than the clearance distance between the inner and outer cylinders 146 and 147, as illustrated in FIG. 17. The location of the partition plates 152 corresponds to the opening 151. The width of each partition plate 152 is larger than the wind box 152 so that the partition plate 152 projects into the clearance 148 between the inner and outer cylinders. In order to define the recirculated gas zone and the combustion air zone, the elements 153 are arch-shaped seal plates which engage with the free ends of the partition plates 152. The seal plates 153 are fixed on an inner wall of the wind box 142.

Figure 18:
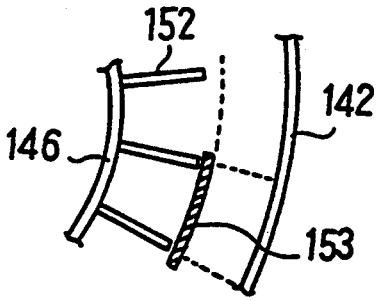
FIG. 18 is a front section of a fragmentary portion of the wind box as taken along the line C—C in FIG. 17.

As shown in FIG. 18, the width of the seal plates 153 is larger than the distance between two adjacent partition plates 152 so that each seal plate 153 always contacts at least one partition plate 152 when there is a relative movement between the partition plates 152 and the seal plates 153. The partition plates 152 are fixed on the inner cylinder 146 whereas the seal plates 153 are fixed on the wind box 142 so that relative movement occurs upon rotation of the rotary furnace 1.

Accordingly, the annular space 143 (FIG. 17) between the inner and outer cylinder 146 and 147 is divided into the two zones separated by the seal plates 153 as shown in FIG. 16. In this embodiment, the partition plates 152 and the seal plates 153 constitute in combination a sealing means. Referring back to FIG. 17, a sealing air chamber 155 is formed on a lateral portion of the wind box 142 at a contact area with the outer cylinder 147. This chamber 155 covers the end 154 of the outer cylinder 147 and seals the clearance between the outer cylinder 147 and the wind box 142.

Figure 19:
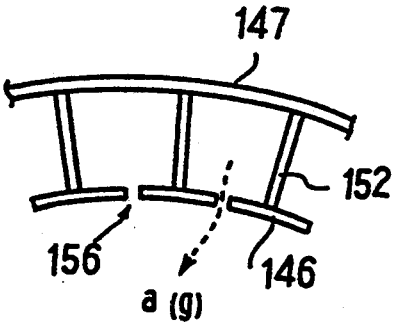
FIG. 19 is a front section of a fragmentary portion of a double lateral wall structure of the furnace shown in FIG. 1A.
Figure 20:
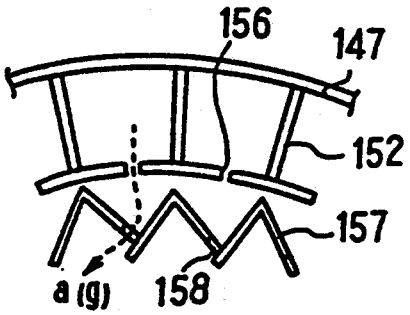
FIG. 20 is a front section of a fragmentary portion of a modification of the structure shown in FIG. 19.

Referring to FIG. 19, a number of openings 156 are formed in the inner cylinder 146. It should be noted that these openings 156 are only formed in an upstream halves of the inner cylinder 146. The arrows in FIG. 15 show this. As shown in FIG. 20, a plurality of V-shaped liners 157 may be provided inside the inner cylinder 146. In this case, an opening 158 is formed in each liner 157 to allow the flow of air "a" or recirculated exhaust gas "g" to pass through. The manner of exhaust gas recirculation and the other structures and functions are similar to those of the first embodiment.

According to this structure, the combustion air "a" and the recirculated gas "g" enter the wind box 142 from the entrance tubes 149 and 150 (FIG. 15), flow through the spaces between the adjacent partition plates 152 (FIG. 16) and the space 148 between the inner and outer cylinders 146 and 147 (FIG. 15) and advance toward the entrance of the rotary furnace 141 (left in FIG. 15). Then, the air flow "a" and the recirculated gas flow "g" enter the inner cylinder 146 from the openings 156 (FIG. 19).

It should be noted here that heat exchange takes place between the space 148 (FIGS. 17) and the inside of the inner cylinder 146 as the air and the recirculated gas flow in the space 148. Specifically, the air and the gas are relatively low in temperature when they enter the wind box 142 whereas the inside temperature of the inner cylinder 146 is high at its exit area so that the inner cylinder 146 is cooled at its exit area. On the other hand, the inside temperature of the inner cylinder 146 is relatively low at its entrance area whereas that of the air and the gas is high, since they have received heat at the exit area of the inner cylinder 146, so that the hot air and gas are introduced into the inner cylinder 146. This results in effective use of the rotary furnace 141.

In this embodiment, the openings 156 are formed only in an upstream half of the inner cylinder. However, their location may be changed depending on the nature of the waste.

Figure 21:
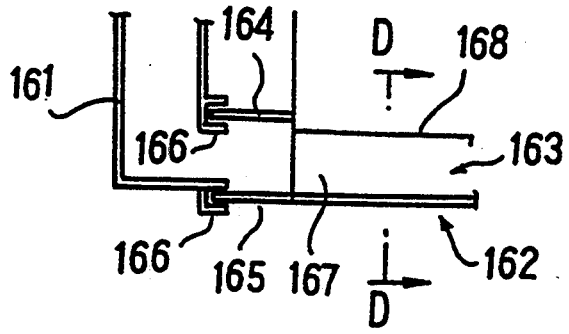
FIG. 21 illustrates in section a fragmentary portion of an incinerator according to a third embodiment of the present invention.
Figure 22:
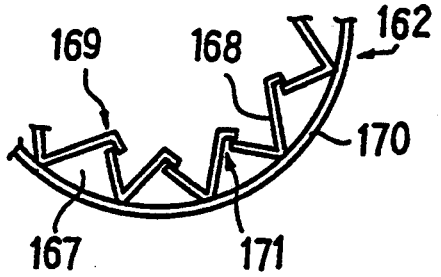
FIG. 22 is a fragmentary sectional view as taken along the line D—D in FIG. 21.
Figure 23:
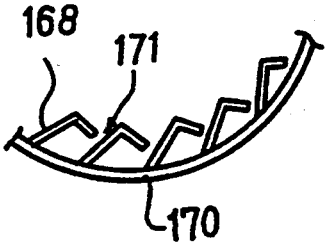
FIG. 23 is a fragmentary sectional view of a modification of a structure shown in FIG. 22.

A third embodiment according to the present invention is shown in FIGS. 21 to 23.

An incinerator of this embodiment is similar to that of the second embodiment. Referring to FIG. 21, the incinerator of the third embodiment has a wind box 161 similar to that shown in FIG. 15. In this embodiment, however, the wind box 161 is mounted at an entrance of a rotary furnace 162. The inside of the wind box 161 communicates with a space 167. Inner and outer annular plates 164 and 165 are provided at the entrance rim of the cylindrical furnace 162. Annular plates 164 and 165 slidably engage with grooves 166. The space 167 is defined by angles 168, as illustrated in FIG. 22. A peripheral wall 163 (FIG. 21) of the furnace 162 is thereby formed by the plurality of angles 168 (FIG. 22).

As shown in FIG. 22, each triangular space 167 has a peak 169. A center of a housing means defined by an outer wall 170 coincides with a center of an imaginary circle touching a plurality of peaks 169. Air and gas injection openings 171 are formed between each adjacent angles 168. Each opening 171 extends in a longitudinal direction of the furnace 162, perpendicular to the plane of the drawing, so that it forms a slit. A plurality of openings 171 may be formed in the longitudinal direction of the furnace. In this case, each opening may be round.

One end of each angle 168 is bent outwardly to the right as viewed in FIG. 22 and overlaps the other end of the next angle 168 so that the air or gas is directed to a peak of the angle 168 towards the housing 170.

Referring to FIG. 23, the angles 168 may be attached to the housing inverted as compared with FIG. 22. In this case, one end of each of the angles 168 are fixed on the housing means outer wall 170 and the openings 171 are formed at the other end of each of the angles 168.

With this structure, waste in the rotary furnace 162 is tumbled and agitated by the contours formed by the angles 168. Thus, the desired combustion will occur. Further, since the housing 170 does not contact the waste, refractory members are not necessary. If the refractory members were mounted on the housing 170, they could fall off. In this embodiment, sealing means is constituted by the double annular plates 164 and 165 and the grooves 166. This sealing means allows a surface contact between the wind box 161 and the peripheral wall 163 of the furnace 162 so that the furnace 162 can rotate smoothly. Other structures and functions of the incinerator of this embodiment are the same as the second embodiment.

The outer annular plate 165 and the housing 170 of the furnace 162 may be continuous.

In the foregoing embodiments, only municipal trash or waste is described as being incinerated by the incinerators according to the invention. However, it should be noted that the incinerator of the present invention can be used to incinerate other materials.

I claim:

1. An incinerator arrangement comprising:

a furnace having portions defining a combustion chamber for burning combustible material, said furnace extending in a longitudinal direction and having an entrance and an exit spaced apart in the longitudinal direction, said furnace also having an upper portion, a lateral portion, and a lower portion, the material being able to be introduced into the entrance of said furnace;

housing means enclosing said furnace portions defining said combustion chamber with a first space between said furnace portions and said housing means, said housing means having an entrance near the entrance of said furnace and an exit near said exit of said furnace;

means for transferring residual material remaining after combustion in said furnace to said exit of the furnace;

a secondary combustor located at said exit of the furnace to receive and burn said residual material transferred from said furnace;

an exhaust gas duct extending from said secondary combustor for discharging gases out of said secondary combustor;

a gas recirculation duct branched from said exhaust gas duct and extending to said furnace housing for recirculating at least a part of the gases discharged from the secondary combustor into said first space;

an air supply duct for directing a flow of air into said first space; and partition means inside said first space for dividing said first space into a first zone and a second zone, said first zone extending along a lower portion of said furnace and said second zone extending at least along a lateral portion of said furnace, said air flow introduced into said first zone by said air supply duct so that it enters the furnace into said lower portion thereof, and said recirculated gas flow is introduced to said second zone by said gas recirculation duct so that said flow enters said lateral portion of said furnace.

2. The incinerator arrangement of claim 1, wherein an ignition nozzle is attached to said entrance of said furnace to assist combustion in the furnace.

3. The incinerator arrangement of claim 1, further including a flow rate controller on said air supply duct and partition plates for dividing said second zone into a plurality of air chambers extending in said longitudinal direction of said furnace, and wherein said air flow is directed into said plurality of air chambers under control of said flow rate controller.

4. The incinerator arrangement of claim 1, wherein said housing has a first opening near said housing exit and said gas recirculation duct is connected with said first opening to cause said recirculated gas flow toward said entrance of said housing in said first space.

5. The incinerator arrangement of claim 1, further including means for detecting combustion in said furnace and a burner in said secondary combustor and directed to the exit of the furnace, and wherein said burner is activated to burn material in said furnace when said detecting means detects incomplete combustion of material in said furnace.

6. The incinerator arrangement of claim 1, further including a boiler in said exhaust gas duct and wherein said gas recirculation duct is branched downstream of said boiler.

7. The incinerator arrangement of claim 1, wherein said furnace has a plurality of second openings and said flow of air and recirculated gas enter said furnace through said second openings.

8. The incinerator arrangement of claim 1, wherein a nozzle is fitted in each second opening and said flow of air or recirculated gas enter said furnace by way of the nozzles.

9. The incinerator arrangement of claim 8, wherein each second opening is defined by a tubular member, a free end of said tubular member projects into said furnace to form a weir which prevents liquid in said furnace from flowing out of said furnace through said second opening.

10. The incinerator arrangement of claim 8, wherein said nozzle has a third opening to cause part of said air flow to enter said furnace as a swirl jet.

11. The incinerator arrangement of claim 8, wherein said second opening has a diameter of about 2 to 3 inches.

12. The incinerator arrangement of claim 8, wherein said furnace has an inner wall and said nozzle has an element to cause the flow of air or recirculation gas to be directed along said inner wall of said furnace.

13. The incinerator arrangement of claim 12, wherein said element is a dish-like member extending in said furnace.

14. The incinerator arrangement of claim 8, wherein each nozzle is threaded into said second opening whereby said nozzle may be fitted in said second opening to an adjustable depth.

15. The incinerator arrangement of claim 8, wherein said nozzle has a plurality of slits through which said flow of air or recirculated gas enter said furnace.

16. The incinerator arrangement of claim 15, wherein each slit opens inside said furnace to form a weir between each slit and said furnace so that said weir prevents liquid from flowing out of said furnace through said slit.

17. The incinerator arrangement of claim 1, wherein said residual material transfer means includes a push rod and a hydraulic cylinder to extend and retract said push rod.

18. The incinerator arrangement of claim 1, wherein said residual material transfer means includes a screw conveyor.

19. The incinerator arrangement of claim 3, wherein said housing has a bottom wall extending from said housing entrance to said housing exit, said bottom wall inclined generally downward and stepwise to form a plurality of step surfaces and said step surfaces correspond to said respective air chambers.

20. The incinerator arrangement of claim 1, wherein said second zone extends only along said lateral portion of said furnace.

21. The incinerator arrangement of claim 1, wherein said second zone extends along both said lateral and upper portions of said furnace.

22. The incinerator arrangement according to claim 1 wherein said furnace is a rotary furnace and wherein said furnace portions include a generally cylindrical body extending in said longitudinal direction which defines an inner wall, said housing means also has a cylindrical body coaxial with said cylindrical body of said furnace and defines an outer wall, and said first space is an annular space therebetween.

23. The incinerator arrangement of claim 22, wherein said outer wall is shorter than said inner wall in said longitudinal direction of said furnace so that a ring-like opening is formed at said exit of said furnace, said space dividing means includes a wind box placed over said ring-like opening of said furnace such that said wind box communicates with said first annular space by way of said ring-like opening, said gas recirculation duct connected with said wind box, a plurality of partition plates radially extending from said inner wall of said furnace at a ring-like opening area, each partition plate having a height corresponding to a clearance between said inner and outer walls, two seal plates fixed on said wind box such that each seal plate contacts at least one of said partition plates whereby said first annular space is divided into said first and second zones by said two seal plates and said partition plates.

24. The incinerator arrangement of claim 23, wherein said seal plates extend in a same cylindrical plane as defined by said outer cylindrical wall and each seal plate has a length in a circumferential direction of said outer cylinder larger than an interval between two adjacent partition plates.

25. The incinerator arrangement of claim 24, wherein an element extends from said wind box over said outer wall to create a second air chamber for sealing clearance between said wind box and said ring-like opening.

26. The incinerator arrangement of claim 22, wherein a plurality of second openings is formed in said inner wall so that said flow of air or recirculated gas enters said inside of said inner wall from said second openings.

27. The incinerator arrangement of claim 26, wherein said second openings are formed in a half of said inner wall on said entrance side of said furnace.

28. The incinerator arrangement of claim 22, wherein a plurality of liners is provided inside said inner wall, each liner comprised of a series of angles extending in said longitudinal direction of said furnace, one edge of each angle contacts the other edge of a next angle, a ridge of each angle faces said inner wall and a third opening is formed in each angle near the one edge thereof whereby said flow of air and recirculated gas enter said inside of said inner wall by way of said third openings.

29. The incinerator arrangement according to claim 1 wherein said furnace portions defining said combustion chamber comprise an annular array of longitudinally extending angle members arranged with inner peaks lying on an imaginary circle, and wherein said housing means comprises an outer cylindrical sleeve having a center aligned with the center of said imaginary circle, said first space defined by the space between each adjacent pair of angle members.

30. The incinerator arrangement of claim 29, wherein each angle member has a ridge attached to said outer wall of said housing means, and free edges of each angle member contacting a free edge of adjacent members so that a first longitudinal passage is defined by one side of one angle and an opposite side of a next angle.

31. The incinerator arrangement of claim 30, wherein one edge of each angle member is bent at its free end so that said free end overlaps said opposite side of said next angle, and an opening is formed in one edge of each angle so that said flow of air and said recirculated gas enter an interior of said furnace from said opening.

32. The incinerator arrangement of claim 29, further including a wind box attached to said furnace so that said flow of air and recirculated gas are directed into said first space.

33. The incinerator arrangement of claim 32, wherein said wind box is mounted to said entrance end of said furnace, and has an annular groove, and wherein said furnace is mounted for rotation and has an extension element at said entrance and said extension element slides in said groove when said furnace rotates.

* * * * *

UNITED STATES PATENT AND TRADEMARK OFFICE

CERTIFICATE OF CORRECTION

PATENT NO. : 5,415,112

DATED : May 16, 1995

INVENTOR(S) : Kenzo Takahashi

It is certified that error appears in the above-identified patent and that said Letters Patent is hereby corrected as shown below:

Column 3, line 54, after "furnace" "i" should be --1--.

Column 3, line 54, after "7" delete ".".

Column 4, line 64, "space" should be --spaced--.

Column 5, line 61, " from" " should be --from--.

Column 8, line 1, "An" should be --A--.

Column 9, line 3, "wind box 152" should be --wind box 142--.

Column 9, line 32, delete "an".

Column 9, line 52, "(FIGS. 17)" should be --(FIG. 17)--.

Column 10,line 21, "angles" should be --pair of angles--.

Signed and Sealed this

First Day of August, 1995

Bruce Lehman

*Attest:*

BRUCE LEHMAN

*Attesting Officer*

*Commissioner of Patents and Trademarks*